US011577144B2

(12) United States Patent
Hagel et al.

(10) Patent No.: US 11,577,144 B2
(45) Date of Patent: Feb. 14, 2023

(54) SILENT PERFORMANCE SYSTEM AND UNDER PADDING CHANNELS IN A TRAMPOLINE

(71) Applicant: Avero AB, Gothenburg (SE)

(72) Inventors: Thomas Hagel, Uddevalla (SE); Kerstin Dahlin, Uddevalla (SE); Henrik Grundström, Gothenburg (SE)

(73) Assignee: Avero AB, Gothenburg (SE)

( * ) Notice: Subject to any disclaimer, the term of this patent is extended or adjusted under 35 U.S.C. 154(b) by 81 days.

(21) Appl. No.: 16/750,410

(22) Filed: Jan. 23, 2020

(65) Prior Publication Data

US 2020/0238120 A1 Jul. 30, 2020

Related U.S. Application Data

(60) Provisional application No. 62/797,214, filed on Jan. 26, 2019, provisional application No. 62/797,216, filed on Jan. 26, 2019, provisional application No. 62/797,215, filed on Jan. 26, 2019.

(51) Int. Cl.

| | |
|---|---|
| ***A63B 71/00*** | (2006.01) |
| ***A63B 5/11*** | (2006.01) |
| ***A63B 21/04*** | (2006.01) |
| ***A63B 21/00*** | (2006.01) |

(Continued)

(52) U.S. Cl.

CPC ..... *A63B 71/0054* (2013.01); *A63B 5/11* (2013.01); *A63B 21/023* (2013.01); *A63B 21/0428* (2013.01); *A63B 21/4033* (2015.10); *A63B 71/023* (2013.01); *A63B 2071/009* (2013.01);

(Continued)

(58) Field of Classification Search

CPC ..... A63B 71/0054; A63B 5/11; A63B 21/023; A63B 21/0428; A63B 21/4033; A63B 71/023; A63B 2071/0063; A63B 2071/009; A63B 2209/00; A63B 71/022; A63B 2208/12

See application file for complete search history.

(56) References Cited

U.S. PATENT DOCUMENTS

| | | |
|---|---|---|
| X504038 | 8/1893 | Judson |
| X652617 | 6/1900 | Holtz |
| 2,370,990 A | 3/1945 | Nissen |

(Continued)

FOREIGN PATENT DOCUMENTS

| | | |
|---|---|---|
| AU | 2015202862 A1 | 12/2015 |
| AU | 2017200402 A1 | 2/2017 |

(Continued)

OTHER PUBLICATIONS

International search report for PCT/EP2017/057961.

(Continued)

*Primary Examiner* — Garrett K Atkinson

(74) *Attorney, Agent, or Firm* — AWA Sweden AB; Thomas L. Ewing

(57) ABSTRACT

Embodiments of the invention provide a series of tensioning straps that are applied to the trampoline frame under tension. The tensioning straps serve to stiffen the trampoline frame which improves performance. The tensioning straps may be improved via the application of various sideways straps as well. The tensioning straps and the sideways straps may reside in channels or loops on the trampoline edge pad in order to further secure the edge pad in place.

20 Claims, 7 Drawing Sheets

(51) Int. Cl.
*A63B 21/02* (2006.01)
*A63B 71/02* (2006.01)

(52) U.S. Cl.
CPC ... *A63B 2071/0063* (2013.01); *A63B 2209/00* (2013.01)

(56) References Cited

U.S. PATENT DOCUMENTS 2,600,572 A * 6/1952 Purviance ..... A63B 5/11 482/28
3,546,721 A 12/1970 Cleary
4,433,838 A 2/1984 Gordon
4,900,011 A 2/1990 Nolet
5,385,518 A * 1/1995 Turner ..... A63B 5/11 482/23
5,399,132 A 3/1995 Bailey
D382,618 S 8/1997 Gift
5,665,040 A 9/1997 Ho
5,700,232 A 12/1997 Clausen et al.
5,776,003 A 7/1998 Kenny
5,810,695 A * 9/1998 Sass ..... B63B 34/52 441/37
5,816,956 A 10/1998 Ellis
5,911,535 A 6/1999 Gvolch
6,001,045 A * 12/1999 Gift ..... A63B 5/11 482/28
6,053,845 A * 4/2000 Publicover ..... A63B 5/11 482/28
6,129,649 A 10/2000 Yang
6,193,632 B1 * 2/2001 Steger ..... A63B 6/02 482/27
6,206,811 B1 3/2001 Lat
6,261,207 B1 7/2001 Publicover
6,319,174 B1 11/2001 Alexander
6,508,682 B1 * 1/2003 Clark ..... B63B 34/52 441/131
6,607,468 B1 8/2003 Nichols et al.
6,672,997 B1 1/2004 Winkler
6,676,576 B1 1/2004 Wu
6,866,617 B2 3/2005 Chen
7,150,699 B2 * 12/2006 Yang ..... A63B 5/11 482/29
D536,405 S 2/2007 Freeman
7,223,187 B1 * 5/2007 Bouffard ..... A63B 71/022 473/492
7,481,740 B2 1/2009 Colling
7,678,024 B2 3/2010 Alexander
7,708,667 B2 5/2010 Alexander
7,731,594 B1 * 6/2010 Hansen ..... A63C 19/005 472/93
7,758,471 B2 7/2010 Nelson
7,850,575 B1 12/2010 Hsiang
7,854,687 B2 12/2010 Alexander
D630,285 S 1/2011 Hsiang
8,105,211 B2 1/2012 Alexander
8,303,469 B2 11/2012 Alexander
8,430,795 B2 * 4/2013 Publicover ..... A63B 5/11 482/35
8,650,724 B2 2/2014 King
8,764,610 B2 7/2014 Chen
8,790,221 B2 7/2014 Schaffer
RE45,182 E 10/2014 Nelson
8,905,898 B2 12/2014 Chen
8,920,290 B2 12/2014 Stokes
9,339,676 B2 5/2016 Publicover
D759,773 S 6/2016 Miller
9,486,658 B2 11/2016 Alexander
9,545,532 B2 1/2017 Miller
9,656,110 B2 5/2017 Alexander
9,700,748 B2 7/2017 Howe
D794,150 S 8/2017 Ji
D794,151 S 8/2017 Ji
9,855,452 B2 * 1/2018 Chen ..... A63B 71/023
9,873,009 B2 1/2018 Miller
10,188,925 B2 1/2019 Freund
10,646,737 B2 * 5/2020 Publicover ..... A63B 71/022
10,688,372 B2 * 6/2020 Chen ..... A63B 71/022
11,174,882 B2 * 11/2021 Bisang ..... A63B 5/11
2002/0137598 A1 * 9/2002 Publicover ..... A63B 5/11 482/27
2003/0064861 A1 4/2003 Chen
2004/0107491 A1 6/2004 Publicover
2004/0121883 A1 6/2004 Publicover
2005/0032609 A1 2/2005 Nissen
2005/0245370 A1 3/2005 Boland
2005/0075223 A1 4/2005 Wu
2005/0187082 A1 8/2005 Bowser
2005/0239618 A1 10/2005 Teng
2005/0255976 A1 11/2005 Hinds et al.
2006/0025289 A1 2/2006 Wallach
2006/0058157 A1 * 3/2006 Greiner ..... A63B 71/022 482/29
2006/0089240 A1 4/2006 Yu
2007/0000182 A1 1/2007 Boujon
2007/0004560 A1 1/2007 Nelson
2008/0009394 A1 1/2008 Van Elverdinghe
2009/0111659 A1 4/2009 Xiang
2009/0264042 A1 10/2009 Chen
2009/0276984 A1 11/2009 Rabe
2010/0035730 A1 * 2/2010 Dukart ..... A63B 5/11 482/27
2011/0256985 A1 10/2011 Mann
2014/0069757 A1 3/2014 Schlipper
2014/0221162 A1 8/2014 Chen
2014/0371031 A1 12/2014 Allen
2015/0045188 A1 2/2015 Allen
2016/0030794 A1 2/2016 Yang
2016/0107016 A1 * 4/2016 Haggerty ..... A63B 21/023 482/29
2016/0296781 A1 10/2016 Andon
2017/0128779 A1 5/2017 Howe et al.
2017/0173376 A1 6/2017 Miller et al.
2017/0173437 A1 6/2017 Chen
2017/0361155 A1 12/2017 McGrane et al.
2019/0046854 A1 * 2/2019 Daffer ..... A63B 63/004
2019/0060692 A1 2/2019 Chang

FOREIGN PATENT DOCUMENTS

CA 2808984 A1 9/2013
CA 2896049 A1 12/2016
CN 1277592 C 10/2006
CN 200957263 Y 10/2007
CN 101102821 A 1/2008
CN 101332348 A 12/2008
CN 201848045 U 6/2011
CN 202237001 U 5/2012
CN 202446713 U 9/2012
CN 201147592 Y 11/2012
CN 202666263 U 1/2013
CN 202876183 U 4/2013
CN 302552501 S 8/2013
CN 203525194 U 4/2014
CN 101918085 A 5/2014
CN 103826707 A 5/2014
CN 103889512 A 6/2014
CN 204261253 U 4/2015
CN 105358223 A 2/2016
CN 106507668 A 3/2017
CN 107427709 A 12/2017
CN 206809609 U 12/2017
CN 207342088 U 5/2018
DE 9013998 U1 1/1991
EP 0265440 A1 5/1988
EP 1044705 A1 10/2000
JP 356063465 U 5/1981
JP 359164654 U 11/1984
JP 363146666 U 9/1988
SE 1651023 A1 2/2018
WO 02087704 A1 11/2002

(56) References Cited

FOREIGN PATENT DOCUMENTS

| | | | |
|---|---|---|---|
| WO | 2009/098324 | A2 | 8/2009 |
| WO | 2014/058364 | A1 | 4/2014 |
| WO | 2017/174567 | A1 | 10/2017 |

OTHER PUBLICATIONS

International search report for PCT/SE2012/051088.
European search report for EP Application No. 20153446.8, entitled "Trampoline with Corner Support Bar," foreign counterpart of U.S. Appl. No. 16/750,391, filed Jan. 23, 2020, also assigned to Avero AB. Search report dated Jun. 5, 2020.
European search report for EP Application No. 20153445.0, entitled "Silent Performance System and Under Padding Channels in a Trampoline," foreign counterpart of U.S. Appl. No. 16/750,410, filed Jan. 23, 2020, also assigned to Avero AB. Search report dated Jun. 8, 2020.
European search report for EP Application No. 20153447.6, entitled "High-Tension Safety Net in a Trampoline," foreign counterpart of U.S. Appl. No. 16/750,427, filed Jan. 23, 2020, also assigned to Avero AB. Search report dated Jun. 4, 2020.

* cited by examiner

SILENT PERFORMANCE SYSTEM AND UNDER PADDING CHANNELS IN A TRAMPOLINE

FIELD

Embodiments of the invention relate to a system of straps that stiffen a trampoline frame. Embodiments of the invention further relate to a trampoline comprising frame stiffening straps and a method for assembling such a strap system in a trampoline.

BACKGROUND

The following description includes information that may be useful in understanding embodiments of the invention. It is not an admission that any of the information provided herein is prior art or relevant to the presently claimed invention, or that any publication specifically or implicitly referenced is prior art.

The modern trampoline era began in the mid-1930s, see, e.g., U.S. Pat. No. 2,370,990 by George Nissen who with Larry Griswold was instrumental in developing the modern trampoline. Even though trampolines were initially developed for competitive or professional purposes, trampolines for recreational use are nowadays popular home entertainment accessories.

A trampoline comprises a flexible mat, a frame, and at least one resilient member. The flexible mat is typically stadium (rectangular with rounded edges), circular, oval, square, or rectangular. The flexible mat may comprise a cloth or net-shaped structure. It may be made of a polymeric material, such as polypropylene. The frame, conventionally made of metal, encompasses the flexible mat and typically has substantially the same shape as the flexible mat. A circular or oval mat is typically surrounded by a circular or oval frame having a larger diameter than the flexible mat, and a square or rectangular mat is typically surrounded by a substantially square or rectangular frame, which however may comprise rounded-off edges (in a stadium-like shape).

The flexible mat typically comprises a plurality of attachments distributed along the mat's edge. The attachments are adapted to receive one or more resilient members for retaining the flexible mat under tension, creating a suspension system. The resilient members may comprise a plurality of springs (e.g. helical springs) that connect the edge of the flexible mat to the frame, thereby tensioning the flexible mat. When a person is using the flexible mat, i.e. jumping on it, the springs will extend in length and thereafter strive to return to their resting length. The spring may be attached to a loop, such as a D-shaped or triangle shaped ring, comprised in the flexible mat by means of a hook that attaches to the spring. Thus, the system of loops and D-rings comprise the plurality of attachments for the flexible mat to receive the resilient members.

In some trampoline embodiments, the resilient member may comprise an elastic cord. Normally, the elastic cord is long enough to go back and forth between the edge of the flexible mat and the frame several times. Each portion connecting the flexible mat to the frame then forms a segment, which correspond to a spring in the above example. The elastic cord may be so long, that only one elastic cord is utilized for the whole mat, or a plurality of elastic cords may be used.

The flexible mat is conventionally surrounded by an edge pad, which is adapted to at least partly cover the at least one resilient member and/or the frame. The edge pad helps prevent users from stepping or landing between the resilient members, e.g. when climbing onto the flexible mat. The edge pad may also be arranged to cover the frame, thereby reducing a possible impact with the frame in case of stepping or landing on the frame. The edge pad is often made as a number of segments, the shapes of which are adapted to the frame and the flexible mat. For a circular or oval mat, the segments may therefore be arc-shaped. For a square or rectangular mat, rectangular segments may be used. Similarly, for a stadium shape, straight and curved pieces may be used.

It is known in the prior art for the trampoline frame to have a series of elastic straps fastened to the frame that provide a separation between the resilient members (e.g., helical spring) and the edge pad. For example, see Chinese Utility Model CN 2014193381 U.

While trampoline construction has improved in recent years, there nevertheless exists a continuous need to improve trampoline construction, especially where such improvements can be accomplished in a commercially reasonable fashion.

SUMMARY OF THE INVENTION

Embodiments of the invention provide a trampoline, comprising a frame having a circumference, a flexible mat, a plurality of resilient members attached to the frame and to the flexible mat, wherein the resilient members receive kinetic energy from a user jumping on the flexible mat, causing the user to be raised above the surface of the flexible mat, and a plurality of first tensioning straps, each strap of the plurality of first tensioning straps attached to the frame such that the circumference of the frame is covered by the plurality of first tensioning straps, wherein the plurality of first tensioning straps provide heightened tension to the frame.

Embodiments of the invention may further comprise a plurality of second tensioning straps that include ratchets for providing additional tension to each strap of the second tensioning straps.

Embodiments of the invention may further provide a plurality of receptacles for receiving the plurality of first tensioning straps and the plurality of second tensioning straps. The plurality of receptacles may comprise one of a plurality of channels and a plurality of loops.

Embodiments of the invention may further provide a plurality of sideways straps. A portion of the plurality of sideways straps may comprise springs that attach to the frame and provide increased tension to at least some straps of the first plurality of straps. A portion of the plurality of sideways straps may comprise hooks that attach to the frame and aid in keeping an edge pad anchored above the frame.

BRIEF DESCRIPTION OF THE DRAWINGS

Embodiments of the invention will be further explained by means of non-limiting examples with reference to the appended drawings. Figures provided herein may or may not be provided to scale. The relative dimensions or proportions may vary. It should be noted that the dimensions of some features of the present invention may have been exaggerated for the sake of clarity.

DETAILED DESCRIPTION OF AN EMBODIMENT OF THE INVENTION

Figure 1:
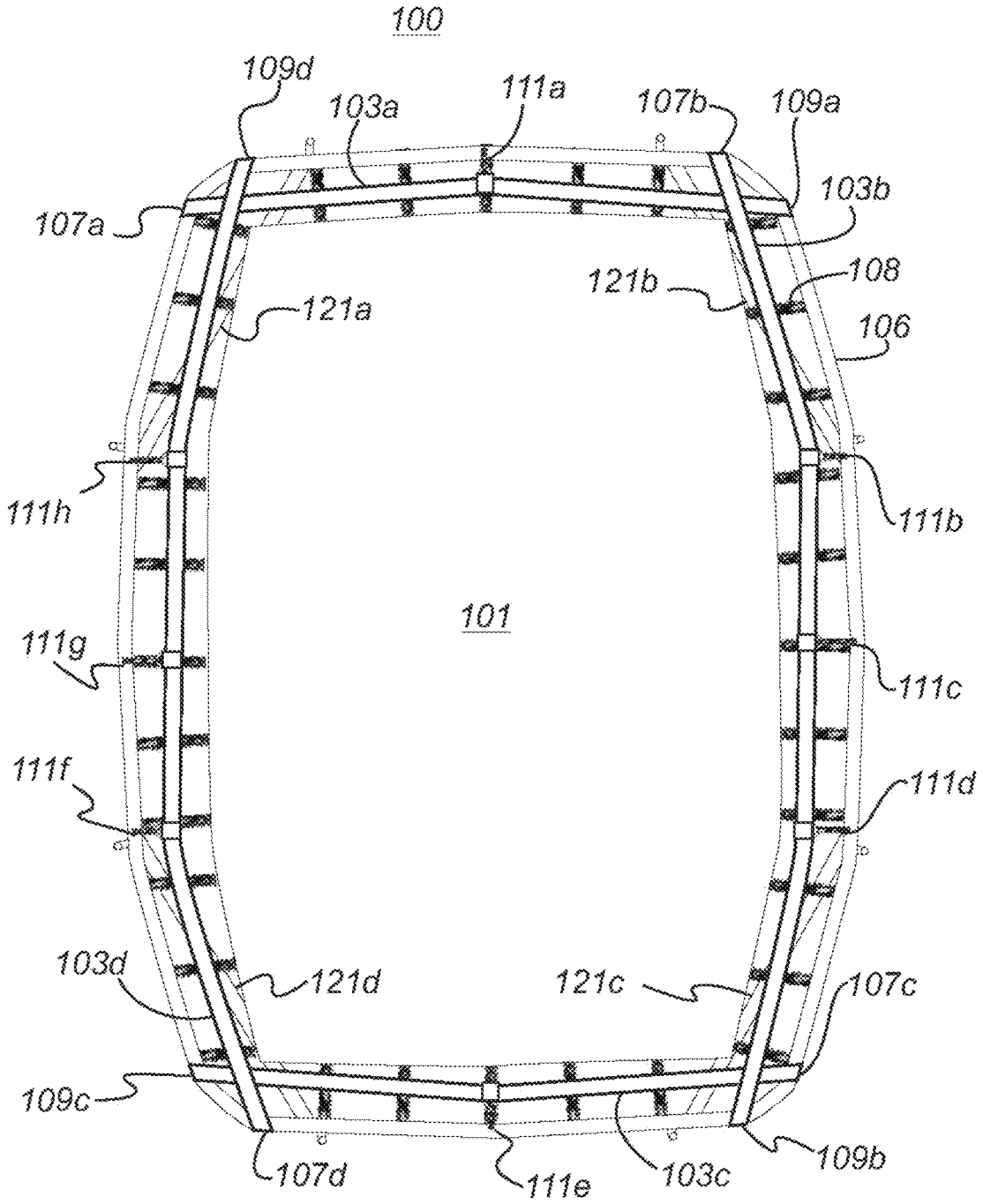
FIG. 1 illustrates a trampoline 100 having tensioning straps 103*a*-103*d* that provide a stiffer frame 106 for the trampoline 100, according to an embodiment of the invention.

Embodiments of the invention provide a set of tensioning straps fastened across the opposite ends of a trampoline to stiffen the trampoline's frame, according to an embodiment of the invention. Thus, a rectangular trampoline may employ a set of four tensioning straps, each tensioning strap fastened from end to opposite end of a trampoline, according to an embodiment of the invention. Further embodiments of the invention may comprise additional sets of tensioning straps fastened across opposite ends of a trampoline.

The set of tensioning straps enable a stiffer trampoline frame, which provides for better trampoline performance, according to an embodiment of the invention. A stiffer frame may also render the trampoline quieter during operation as well. Embodiments of the invention may, in some instances, stiffen the trampoline frame to the extent that the trampoline itself makes almost no noise during use with the primary sound produced not by the jingling of the resilient members (e.g., helical springs) but by the sound of the user's body (e.g., feet) striking the trampoline mat.

A further set of sideways straps may be applied to the tensioning straps, according to an embodiment of the invention. The sideways straps may create further tension in the tensioning straps, increasing the benefits provided by the tensioning straps. The sideways straps may also assist in keeping the trampoline edge padding in place both in terms of its sideways movement but also in terms of its position on the trampoline, according to an embodiment of the invention.

An edge pad may be applied on top of the tensioning straps and the sideways straps, according to an embodiment of the invention. Attaching the edge pad to the tensioning straps and sideways straps helps keep the edge pad in place as the flexible mat moves up and down. Attaching the tensioning straps and the sideways straps to the edge padding may reduce movement of the edge pad as the trampoline's flexible mat moves during operation. In addition, the tensioning straps and the sideways straps may hold the edge padding above the trampoline's suspension system (e.g., helical springs), which means that the edge padding is less likely to engage with the trampoline's suspension system, as well as the flexible mat, during operation, according to an embodiment of the invention.

The edge pad may include a plurality of channels and/or loops through which the tensioning straps and/or sideways straps may pass, according to an embodiment of the invention. The channels or loops may be attached to the edge pad by means of stitching, and the tensioning straps and sideways straps may be fed into through the channels and/or loops to hold the edge pad in place. The channels and/or loops may enable a sideways suspension system for the edge pad, according to an embodiment of the invention. The channels and/or loops may also facilitate assembly of the trampoline, according to an embodiment of the invention.

Embodiments of the invention also provide a sideways suspension system for the trampoline edge pad. The edge pad may include a combination of springs and rubber bands that enable a specialized frame hook to attach the edge pad securely to the trampoline frame, according to an embodiment of the invention. One end of the springs/elastic band is fastened to the sideways straps used to provide further tension to the tensioning straps. In this embodiment of the invention, the edge pad is flexible in sideways motion while at the same time being returning to the correct position to be able to protect from the hard trampoline parts. This embodiment also simplifies trampoline mounting. In conventional application, the rubber straps of the edge pad rotate around the cylindrical trampoline frame.

FIG. 1 illustrates a trampoline 100 having tensioning straps 103*a*-103*d* that stiffen a frame 106 for the trampoline 100, according to an embodiment of the invention. Each tensioning strap 103*a*-103*d* is fastened at opposite ends of the frame 106. For example, the strap 103*a* is fastened at point 107*a* and at 109*a*. Likewise, the tensioning straps 103*b*-103*d* are respectfully fastened at points 107*b*-107*d*, 109*b*-109*d*.

Fastening the tensioning straps 103*a*-103*d* respectively between attachment point pairs 107*a*-107*d*, 109*a*-109*d* may impart tension to the frame 106, stiffening the frame 106, according to an embodiment of the invention. In other words, the strap 103*a* is attached to the points 107*a*, 109*a*, for example. The tensioning straps 103*a*-103*d* are attached to the attachment point pairs 107*a*-107*d*, 109*a*-109*d* under tension, according to an embodiment of the invention. The tension may be applied in a number of ways known to those of ordinary skill in the relevant field.

The tensioning straps 103*a*-103*d* are also attached to a side of the frame 106 by sideways straps 111*a*-111*h*, according to an embodiment of the invention. The sideways straps 111*a*-111*h* provide further tension to the tensioning straps 103*a*-103*d*. In other words, the strap 103*a* is tensioned by the sideways strap 111*a*, for example. In some embodiments of the invention, the sideways straps 111*a*-111*h* may collectively provide greater tension to the straps 103*a*-103*d* than the connection at the attachment point pairs 107*a*-107*d*, 109*a*-109*d*.

The combination of the tension provided at the attachment point pairs 107*a*-107*d*, 109*a*-109*d* and the sideways straps 111*a*-111*h* may provide a significant tension increase in comparison to a frame 106 having no such tension mechanism. The additional tension provided by the strap 103*a*, connected under tension at points 107*a*, 109*a* and under further tension by the sideways strap 111*a* may increase the tension in the frame 106 from 300 N to 800 N, according to an embodiment of the invention. The range of increased tension depends on a variety of factors, including the cost of components, thus even lower levels of tension may be applied in some embodiments, such as 250 N.

The trampoline 100 includes a mat 101 held to the frame 106 by a plurality of resilient members 108, e.g., helical springs. Each resilient member attaches to a respective D-ring that itself attaches to the mat 101. The tension between the mat 101 and the resilient members 108 creates a suspension system for the trampoline 100. Thus, the resilient members 108 comprise a suspension system between the mat 101 and the frame 106 for the trampoline 100. Trampoline users jump or bounce on the mat 101 in a vertical direction and possibly also move in a horizontal direction perpendicular to the first direction. This arrangement of the suspension system is known in the prior art, such as shown in PCT/EP2017/057961, "Safety Net for a Trampoline, A Trampoline, and a Method of Arranging a Safety Net in a Trampoline," which is hereby incorporated by reference.

The fabric of the flexible mat 101 that users jump or bounce on is often not elastic itself, instead the resilient members 108 (e.g., helical springs) provide the elasticity which creates the potential energy.

Figure 2:
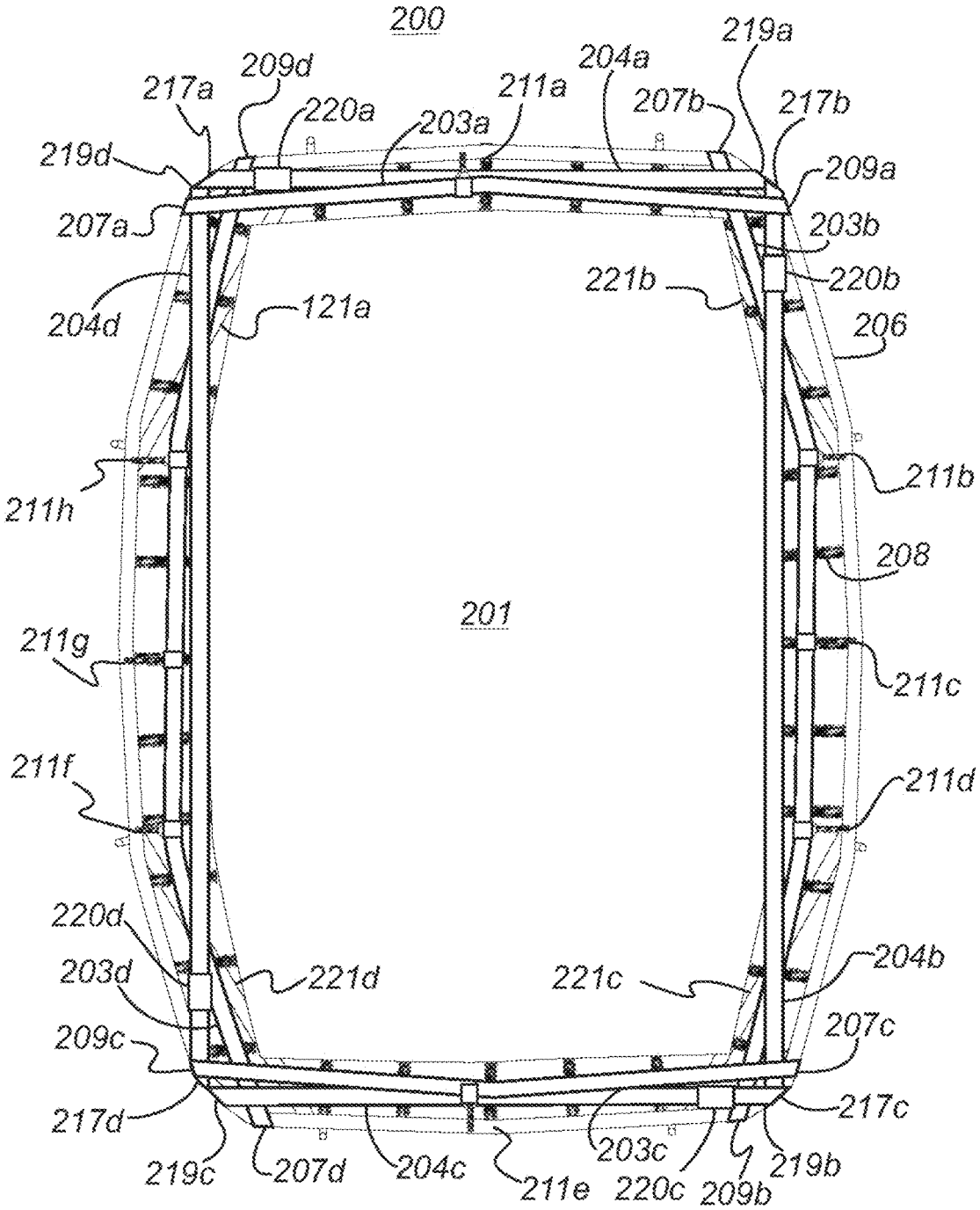
FIG. 2 illustrates a trampoline 200 having a first set of tensioning straps 203*a*-203*d* and a second set of tensioning straps 204*a*-204*d* that provide a stiffer frame 206 for the trampoline 200, according to an embodiment of the invention.

FIG. 2 illustrates a trampoline 200 having a first set of tensioning straps 203*a*-203*d* and a second set of tensioning straps 204*a*-204*d* that together provide a stiffer frame 206 for the trampoline 200, according to an embodiment of the invention. Each strap 203*a*-203*d* of the first set of tensioning straps is fastened at opposite ends of the frame 206. In other words, the strap 203*a* is fastened at point 207*a* and at 209*a*. Likewise, the tensioning straps 203*b*-203*d* are respectfully fastened at points 207*b*-207*d*, 209*b*-209*d*.

Similarly, each strap 204*a*-204*d* of the second set of tensioning straps is fastened at opposite ends of the frame 206. In other words, the strap 204*a* is fastened at point 217*a* and at 219*a*. Likewise, the tensioning straps 204*b*-204*d* are respectfully fastened at points 217*b*-217*d*, 219*b*-219*d*.

The first set of tensioning straps 203*a*-203*d* may be attached to the points 207*a*-207*d*, 209*a*-209*d* under tension. The second set of tensioning straps 204*a*-204*d* may be attached to the points 217*a*-217*d*, 219*a*-219*d* under tension. The tension may be applied in a number of ways, according to various embodiments of the invention.

The tensioning straps 203*a*-203*d* are also attached to a side of the frame 206 by sideways straps 211*a*-211*h*. The sideways straps 211*a*-211*h* provide further tension to the tensioning straps 203*a*-203*d*, according to an embodiment of the invention. In some embodiments of the invention, the sideways straps 111*a*-111*h* may collectively provide greater tension to the straps 103*a*-103*d* than the connection at the points 107*a*-107*d*, 109*a*-109*d*.

The combination of the tension provided at the points 207*a*-207*d*, 209*a*-209*d* and the sideways straps 211*a*-211*h* may provide a significant tension increase in comparison to the frame 206 having no such tension mechanism. The additional tension provided by the strap 203*a*, connected under tension at points 207*a*, 209*a* and under further tension by the sideways strap 211*a* may increase the tension in the frame 206 from 300 N to 800 N, according to an embodiment of the invention. The range of increased tension depends on a variety of factors, including the cost of components, thus even lower levels of tension may be applied in some embodiments, such as 250 N.

The tensioning straps 204*a*-204*d* are also tensioned by ratchets 220*a*-220*d*. The ratchets 220*a*-220*d* may comprise devices capable of delivering very high tensioning, including tensioning exceeding that of the tension provided by the sideways straps 111*a*-111*h* for the tensioning straps 203*a*-203*d*, according to an embodiment of the invention.

The combination of the tension provided at the points 217*a*-217*d*, 219*a*-219*d* and ratchets 220*a*-220*d* may provide a significant tension increase in comparison to a frame 206 having no such tension mechanism. The additional tension provided by the strap 204*a*, connected under tension at points 217*a*, 219*a* and under further tension by the ratchet 220*a* may increase the tension in the frame 206 from 3000 N-4000 N, according to an embodiment of the invention. The range of increased tension depends on a variety of factors, including the cost of components, thus even lower levels of tension may be applied in some embodiments, such as 2500 N.

The trampoline 200 includes a mat 201 held to the frame 206 by a plurality of resilient members 208, e.g., helical springs. Each resilient member attaches to a respective D-ring that itself attaches to the frame 206. The tension between the mat 201 and the resilient members 208 creates a suspension system for the trampoline 200. The resilient members 208 comprise a suspension system between the mat 201 and the frame 206 for the trampoline 200. Trampoline users jump or bounce on the mat 201 in a vertical direction and possibly also move in a horizontal direction perpendicular to the first direction.

As previously discussed, the flexible mat 201 is retained in tension by a plurality of resilient members 208 (e.g., coiled springs), according to an embodiment of the invention. The resilient members 208 are attached at or adjacent to an edge of the flexible mat 201. The resilient members 208 attach to an underside surface of the frame 206. The first set of tensioning straps 203*a*-203*d* and the second set of tensioning straps 204*a*-204*d* attach to the frame 206 at a position well above the resilient members 208, such that the resilient members 208 will not come into contact with either the first set of tensioning straps 203*a*-203*d* or the second set of tensioning straps 204*a*-204*d* during operation of the trampoline 200 by various users.

The fabric of the flexible mat 201 that users jump or bounce on is often not elastic itself, instead the resilient members 208 (e.g., helical springs) provide the elasticity which creates the potential energy. The thickness of the flexible mat 201 is typically in the range of 0.2 mm to 1 mm. However, the flexible mat 201 is usually reinforced at its edge, resulting in a higher thickness at the edge of the flexible mat 201.

Figure 3A:
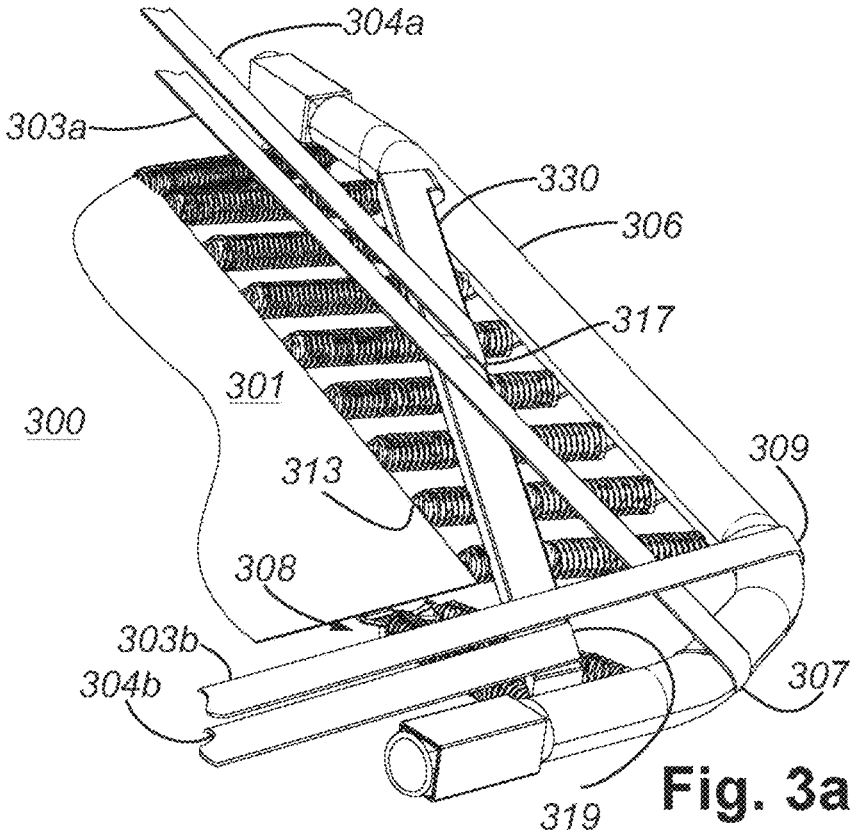
FIG. 3A shows tensioning straps 303*a*, 303*b* attached to the frame 306 and tensioning straps 304*a*, 304*b* attached to a corner support bar 330 in a trampoline 300, according to an embodiment of the invention.

FIG. 3A shows tensioning straps 303*a*, 303*b* attached to the frame 306 and tensioning straps 304*a*, 304*b* attached to a corner support bar 330 in a trampoline 300, according to an embodiment of the invention. The trampoline 300 may include the corner support bar 330 to provide increased strength and to also increase the stiffness to the frame 306, especially the area of the frame 306 covered by the corner support bar 330 and the trampoline's legs. Further embodiments of the corner support bar are disclosed in U.S. Provisional Application 62/797,214, entitled "Corner Support Bar (CSB) in a Trampoline," naming as its inventor Thomas Hagel, filed on 26 Jan. 2019, the application of which is hereby incorporated by reference in its entirety.

FIG. 3A illustrates a partial view of the trampoline 300 having a first set of tensioning straps 303*a*, 303*b* and a second set of tensioning straps 304*a*, 304*b* that together provide a stiffer frame 306 for the trampoline 300, according to an embodiment of the invention. The tensioning straps 303*a*, 303*b*, 304*a*, 304*b* are placed above resilient members 308 (e.g., helical springs) that provide the tensioning system for the trampoline.

The tensioning straps 303*a*, 303*b* are fastened at both ends of the frame 306. In other words, the tensioning strap 303*a* is fastened at point 307, and the tensioning strap 303*b* is fastened at point 309, according to an embodiment of the invention. The tensioning strap 303*a* would also be fastened at the opposite end of the trampoline 300. The tensioning strap 303*b* would be similarly fastened at the opposite end of the trampoline 300.

The tensioning straps 304*a*, 304*b* are fastened on the corner support bar 330 at both ends of the frame 306, according to an embodiment of the invention. The tensioning strap 304*a* is respectfully fastened at point 317, and the tensioning strap 304*b* is fastened at point 319. Similarly, the strap 304*a* is also fastened at a corner support bar on an opposite end of the frame 306, and the strap 304*b* would also be fastened at another opposite end of the frame 306.

The tensioning straps 303*a*, 303*b* are attached to the points 307, 309 under tension. The tensioning straps 304*a*, 304*b* are similarly attached to the points 317, 319 under tension. The tension may be applied in a number of ways.

The tensioning straps 303*a*, 303*b* would likely be tensioned by sideways straps, such as the sideways straps 211*a*-211*h* shown in FIG. 2 used to tighten the tensioning straps 203*a*-203*d*.

The tensioning straps 304*a*, 304*b* are similarly attached to the points 317, 319 under tension. The tensioning straps 304*a*, 304*b* may be tensioned at a different (e.g., higher) tension than the tensioning straps 303*a*, 303*b*. Among other things, the tensioning straps 304*a*, 304*b* may be tensioned using a ratchet, such as the ratchet 220*a*-220*d* shown in FIG. 2 to tighten the tensioning straps 204*a*-204*d*, according to an embodiment of the invention.

Figure 3B:
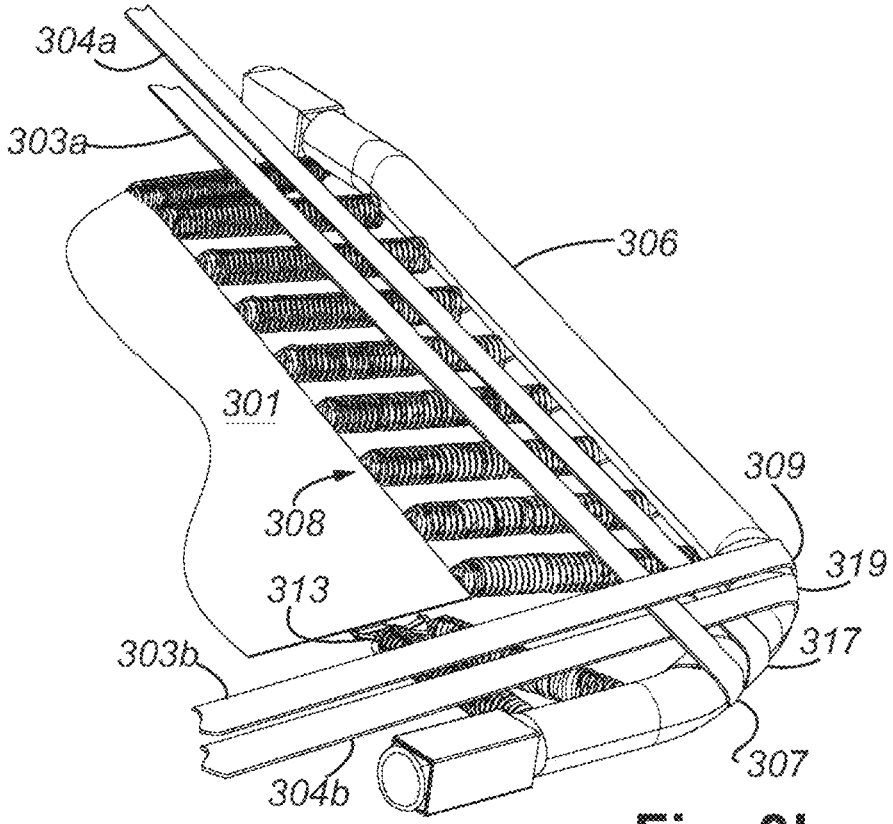
FIG. 3B illustrates a partial view of a trampoline 300 having a first set of tensioning straps 303*a*, 303*b* and a second set of tensioning straps 304*a*, 304*b* that provide a stiffer frame 306 for the trampoline 300, according to an embodiment of the invention.

FIG. 3B illustrates a partial view of the trampoline 300 having a first set of tensioning straps 303*a*, 303*b* and a second set of tensioning straps 304*a*, 304*b* that together provide a stiffer frame 306 for the trampoline 300, according to an embodiment of the invention. The tensioning straps 303*a*, 303*b*, 304*a*, 304*b* are placed above resilient members 308 (e.g., helical springs) that provide the tensioning system for the trampoline.

The tensioning straps 303*a* 303*b*, 304*a*, 304*b* are fastened at both ends of the frame 306. In other words, the strap 303*a* is fastened at point 307, and the tensioning strap 303*b* is fastened at point 309, according to an embodiment of the invention. The tensioning strap 303*a* would also be fastened at the opposite end of the trampoline 300. The tensioning strap 303*b* would be similarly fastened at the opposite end of the trampoline 300.

The tensioning straps 303*a*, 303*b* are attached to the points 307, 309 under tension. The tensioning straps 303*a*, 303*b* would likely be tensioned by sideways straps, such as the sideways straps 211*a*-211*h* shown in FIG. 2 used to tighten the tensioning straps 203*a*-203*d*.

Likewise, the tensioning strap 304*a* is respectfully fastened at point 317, and the tensioning strap 304*b* is fastened at point 319. Similarly, the tensioning strap 304*a* is also fastened at an opposite ends of the frame 306, and the tensioning strap 304*b* would also be fastened at an opposite end of the frame 306.

The tensioning straps 304*a*, 304*b* are similarly attached to the points 317, 319 under tension. The tensioning straps 304*a*, 304*b* may be tensioned at a different (e.g., higher) tension than the tensioning straps 303*a*, 303*b*. Among other things, the tensioning straps 304*a*, 304*b* may be tensioned using a ratchet, such as the ratchet 220*a*-220*d* shown in FIG. 2 to tighten the tensioning straps 204*a*-204*d*, according to an embodiment of the invention.

Figure 4:
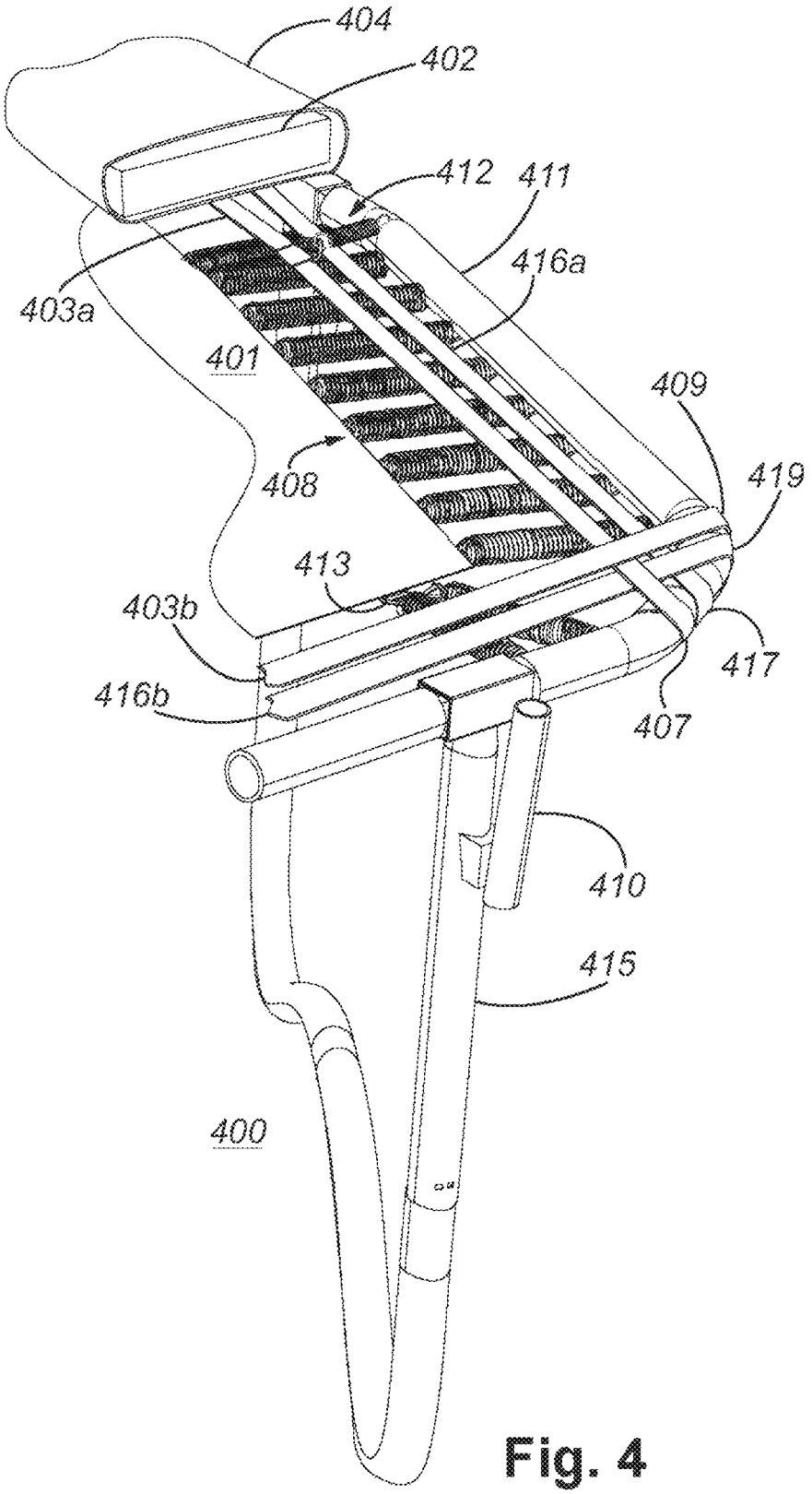
FIG. 4 illustrates a perspective view of a portion of a trampoline 400 having a first set of tensioning straps 403*a*, 403*b* and a second set of tensioning straps 416*a*, 416*b* that stiffen a frame 411 for the trampoline 400, according to an embodiment of the invention.

FIG. 4 illustrates a perspective view of a portion of a trampoline 400 having a first set of tensioning straps 403*a*, 403*b* and a second set of tensioning straps 416*a*, 416*b* that together stiffen a frame 411 of the trampoline 400, according to an embodiment of the invention. The tensioning straps 403*a*, 403*b* are fastened at both ends of the frame 411. As shown in FIG. 4, the tensioning strap 403*a* is fastened at point 407, and the tensioning strap 403*b* is fastened at point 409. Both the tensioning strap 403*a* and the tensioning strap 403*b* would be similarly fashioned at their respective opposite corners of the trampoline 400. Likewise, the tensioning straps 416*a*, 416*b* are respectfully fastened at points 417 and 419. Similarly, the tensioning straps 416*a*, 416*b* are fastened at their respective opposite ends of the frame 411.

The tensioning straps 403*a*, 403*b* are attached to the points 407, 409 under tension, according to an embodiment of the invention. The tensioning straps 416*a*, 416*b* are similarly attached to the points 417, 419 under tension. The tension may be applied in a number of ways. The tensioning straps 403*a*, 403*b* may be tensioned by sideways straps, such as the sideways straps 211*a*-211*h* shown in FIG. 2 used to tighten the tensioning straps 203*a*-203*d*, and the tensioning straps 416*a*, 416*b* may be tensioned by a ratchet, such as the ratchet 220*a*-220*d* shown in FIG. 2 to tighten the tensioning straps 204*a*-204*d*, according to an embodiment of the invention.

As shown in FIG. 4, an edge pad 404 comprises a covering that has been crimped or folded to facilitate the insertion of a cushioning material 402 into the edge pad 404, according to an embodiment of the invention. The cover of the edge pad 404 may comprise a durable plastic material while the cushioning material 413 may comprise a softer, shock-absorbing material such as foam rubber.

The edge pad 404 covers the frame 411 and the trampoline suspension system (e.g., the resilient member 408). The resilient member 408 (e.g., a coiled spring), one member of the set of resilient members of the trampoline suspension system, attaches at one end to the frame 411 and at the other end to a D-ring that itself attaches to the flexible mat 401. The tensioning straps 403*a*, 403*b*, 416*a*, 416*b* reside between the edge pad 404 and the resilient members 408 and may serve to prevent the edge pad 404 from engaging with the tensioning members 404 during trampoline operation, according to an embodiment of the invention.

The trampoline frame 411 is supported by multiple legs, such as a leg 415, that engage with a floor surface, e.g., the ground. The leg 415 may include one or more attachment points 410 for a safety net, such as the safety net 722 shown in FIG. 7.

Figure 5A:
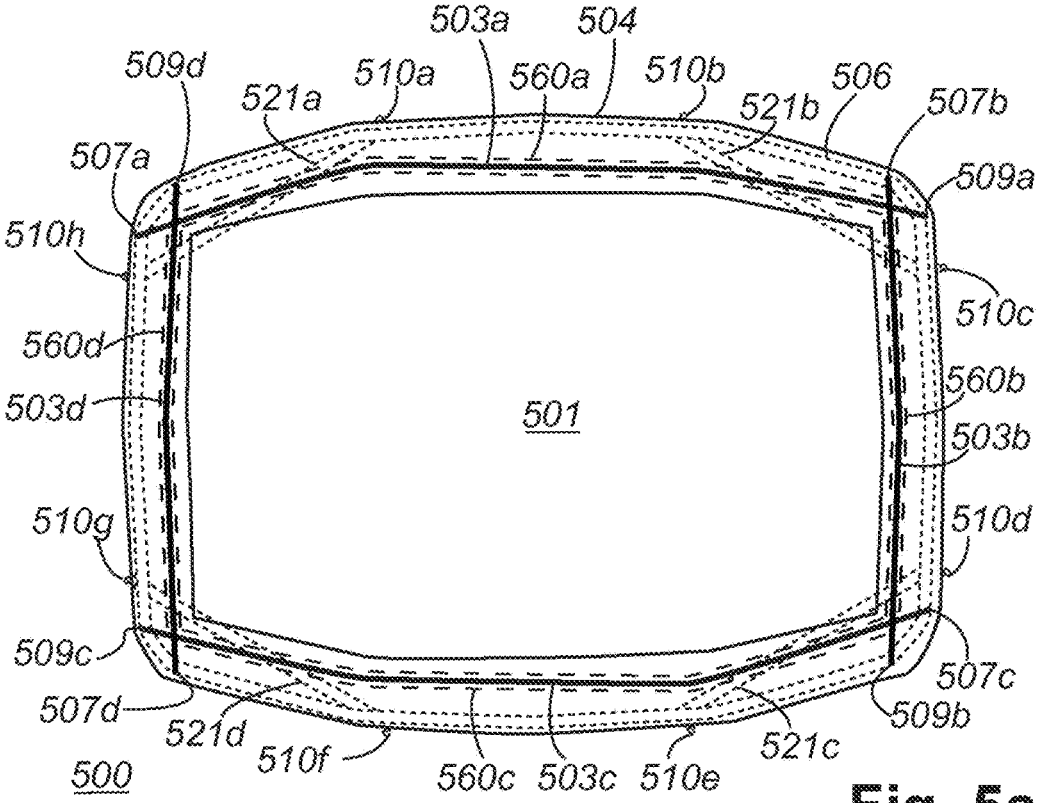
FIGS. 5A-5B illustrate two views of a portion of a trampoline 500 having tensioning straps 503*a*-503*d* to provide a stiffer frame 506 for the trampoline 500, according to an embodiment of the invention.
Figure 5B:
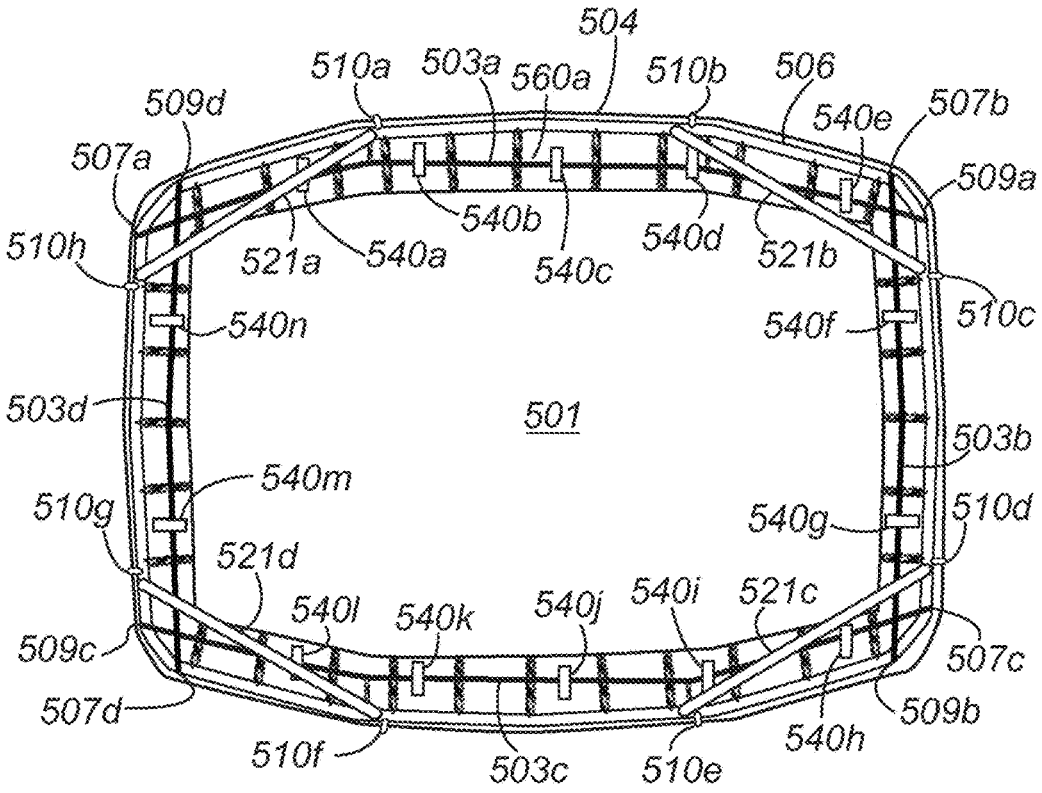

FIGS. 5A-5B illustrate two views of a portion of a trampoline 500 having tensioning straps 503*a*-503*d* to provide a stiffer frame 506 for the trampoline 500, according to an embodiment of the invention. As shown FIG. 5A, the tensioning straps 503*a*-503*d* reside in a series of channels (or pockets) 560*a*-560*d* on an underside of edge pad 504, according to an embodiment of the invention. As shown in FIG. 5B, the tensioning straps 503*a*-503*d* reside in a series of loops 540*a*-540*n*, according to an alternative embodiment of the invention.

The tensioning straps 503*a*-503*d* are fastened at both ends of the frame 506. In other words, the tensioning strap 503*a* is fastened at point 507*a* and at point 509*a*. Likewise, the tensioning straps 503*b*-503*d* are respectfully fastened at points 517*b*-517*d* and 519*b*-519*d*. The tensioning straps 503*a* is attached to the points 507*a*, 509*a* under tension. The tension may be applied in a number of ways.

The tensioning straps 503*a*-503*d* are also attached to a side of the frame 506 by sideways straps 510*a*-510*h*. The sideways strap 510*a* provides further tension to the tensioning strap 503*a*. The sideways strap 510*a* operating in conjunction with the tensioning strap 503*a* may also act to hold the edge pad 504 in place on the frame 506 since the tensioning strap 503*a* and sideways strap 510*a* are not only attached to the edge pad 504 but they are also attached to the frame 506.

As shown in FIG. 5A, the tensioning straps 503*a*-503*d* reside in channels (or pockets) 560*a*-560*d* attached to the edge pad 504. The pockets 540*a*-540*n* may completely cover the under surface of the edge pad 504 (apart from openings for tensioning straps and sideways straps), or the pockets may comprise a series of loops, such as the loops shown in FIG. 5B, that hold the tensioning straps 503*a* to the edge pad 504.

FIG. 5B illustrates the edge pad 504 from the underside showing the tensioning straps 503*a*-503*d* residing in a series of loops 540*a*-540*n*, according to an embodiment of the invention.

The tensioning straps 503*a*-503*d* are fastened at both ends of the frame 506. In other words, the tensioning strap 503*a* is fastened at point 507*a* and at point 509*a*, for example. Likewise, the tensioning straps 503*b*-503*d* are respectfully fastened at points 507*b*-507*d* and 509*b*-509*d*. The tensioning strap 503*a* is attached to the points 507*a*, 509*a* under tension. The tension may be applied in a number of ways.

The tensioning straps 503*a*-503*d* are also attached to a side of the frame 506 by sideways straps 510*a*-510*h*. The sideways strap 510*a* provides further tension to the tensioning strap 503*a*, according to an embodiment of the invention. The combination of tensioning straps 503*a*-503*d* and sideways straps 510*a*-510*h* may act to hold the edge pad 504 in proper position since the tensioning straps 503*a*-503*d* and the sideways straps 510*a*-510*h* are not only attached to the edge pad 504, they are also attached to the frame 506.

As shown in FIG. 5B, the tensioning straps 503*a*-503*d* reside in loops 540*a*-540*n* attached to the edge pad 504. The loops 540*a*-540*n* hold the tensioning straps 503*a*-503*d* to the edge pad 504 and prevent the edge pad from moving while users are engaged in jumping on the flexible mat 501 of the trampoline 500, according to an embodiment of the invention.

FIGS. 5A-5B also shows trampoline legs 521*a*-521*c* that hold the trampoline 500 above ground.

The pockets and loops shown in FIGS. 5A-5B are amendable to including additional sets of pockets and loops for additional tensioning straps, such as the tensioning straps 204*a*-204*d* shown in FIG. 2, according to an embodiment of the invention.

Figure 6A:
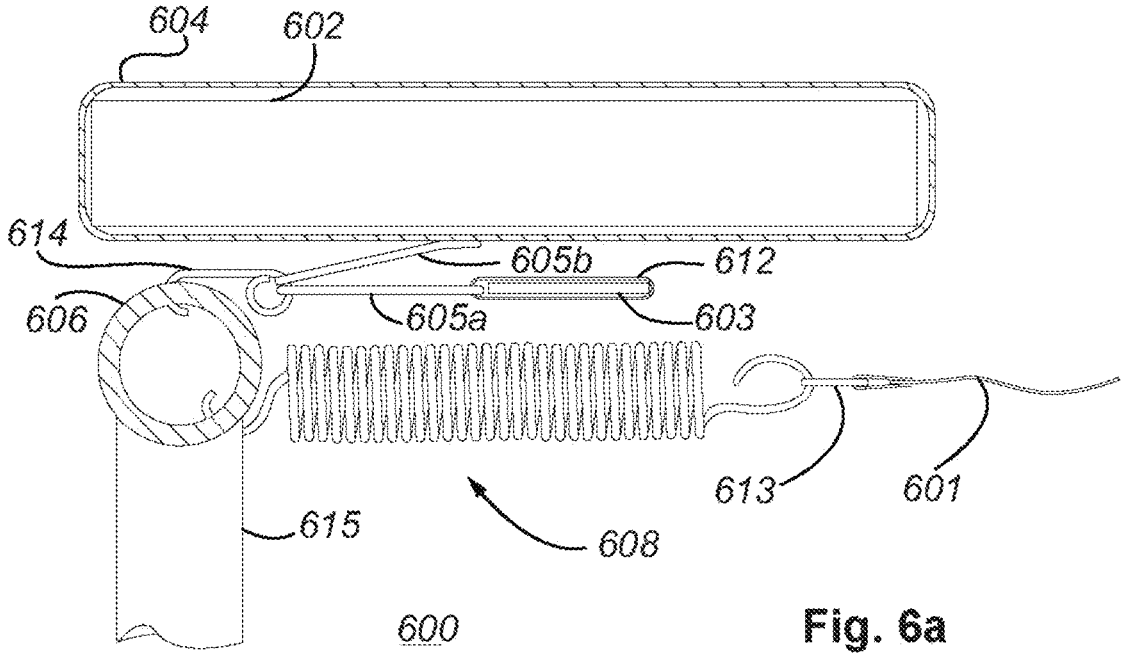
FIG. 6A illustrates a perspective view of a trampoline 600 having a sideways strap combination 614, 605*b* that connects an edge pad 604 to a frame 606, according to an embodiment of the invention.

FIG. 6A illustrates a perspective view of a trampoline 600 having a sideways strap combination 614, 605*b* that connects an edge pad 604 to a frame 606, according to an embodiment of the invention. The sideways strap combination includes a specialized frame hook 614 attached to a flexible (stretchable) material 605*b*, such as a heavy-duty rubber band, that attaches the edge pad 604 securely to the trampoline frame 606, according to an embodiment of the invention.

Another piece of flexible (stretchable) material 605*a* is fastened to the tensioning strap 603, such as the tensioning strap 203*a* shown in FIG. 2. The attachment 605*a* may also comprise a flexible (stretchable) material such as a rubber band, according to an embodiment of the invention. The combination of the specialized frame hook 614 and the flexible (stretchable) material 605*a* adds further tension to the tensioning strap 203*a*.

In this embodiment, the edge pad 604 is flexible in sideways motion during operation while at the same time returning (e.g., springing back) to the correct position to protect the user from the hard trampoline parts due to the sideways strap combination 614, 605*b* that connects the edge pad 604 to the frame 606. This embodiment may also simplify trampoline mounting and assembly. (In a conventional application, the rubber straps of the edge pad tend to rotate around the cylindrical trampoline frame instead of being attached firmly by a hook like the specialized frame hook 614.)

As shown in FIG. 6A, the edge pad 604 comprises a covering that has been crimped or folded to facilitate the insertion of a cushioning material 602 into the edge pad 604, according to an embodiment of the invention. The edge pad 604 cover may comprise a durable plastic material while the cushioning material 602 may comprise a material such as foam rubber.

The edge pad 604 covers the frame 606 and the trampoline suspension system (e.g., the resilient member 608). The resilient member 608 (e.g., a coiled spring), one member of the set of resilient members of the trampoline suspension system, attaches at one end to the frame 606 and at the other end to a D-ring 613 that itself attaches to the flexible mat 601. Thus, the edge pad 604 resides above the frame 606 and the trampoline suspension system 608.

Figure 6B:
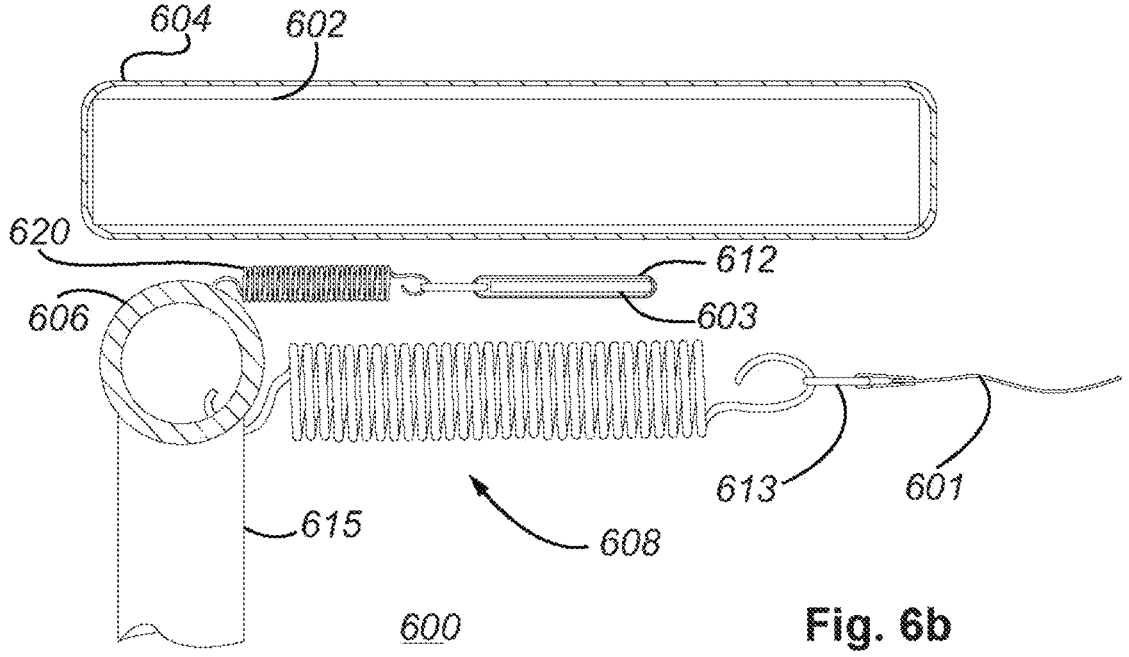
FIG. 6B illustrates a perspective view of the trampoline 600 having a sideways strap 620 that applies tension to the sideways strap 603, according to an embodiment of the invention.

FIG. 6B illustrates a perspective view of the trampoline 600 having a sideways strap 620 that applies tension to the tensioning strap 603, according to an embodiment of the invention. In the portion of the trampoline 600 shown in FIG. 6B, the sideways strap combination 614, 605*a* shown in FIG. 6A has been replaced with the sideways strap 620. The sideways strap 620 performs the same functions as the sideways strap combination 614, 605*a* but also provides heightened tension to the tensioning strap 603 through the use of a coiled spring (somewhat like a smaller version of the resilient member 608) rather than the rubber band 605*a* and the hook 614.

The trampoline 600 may include a mix of sideways straps 620 and sideways straps 614, 605*a*, depending on factors such as how much additional tension should be imparted to the tensioning strap 603 and other factors such as manufacturing expenses, according to an embodiment of the invention.

Figure 7:
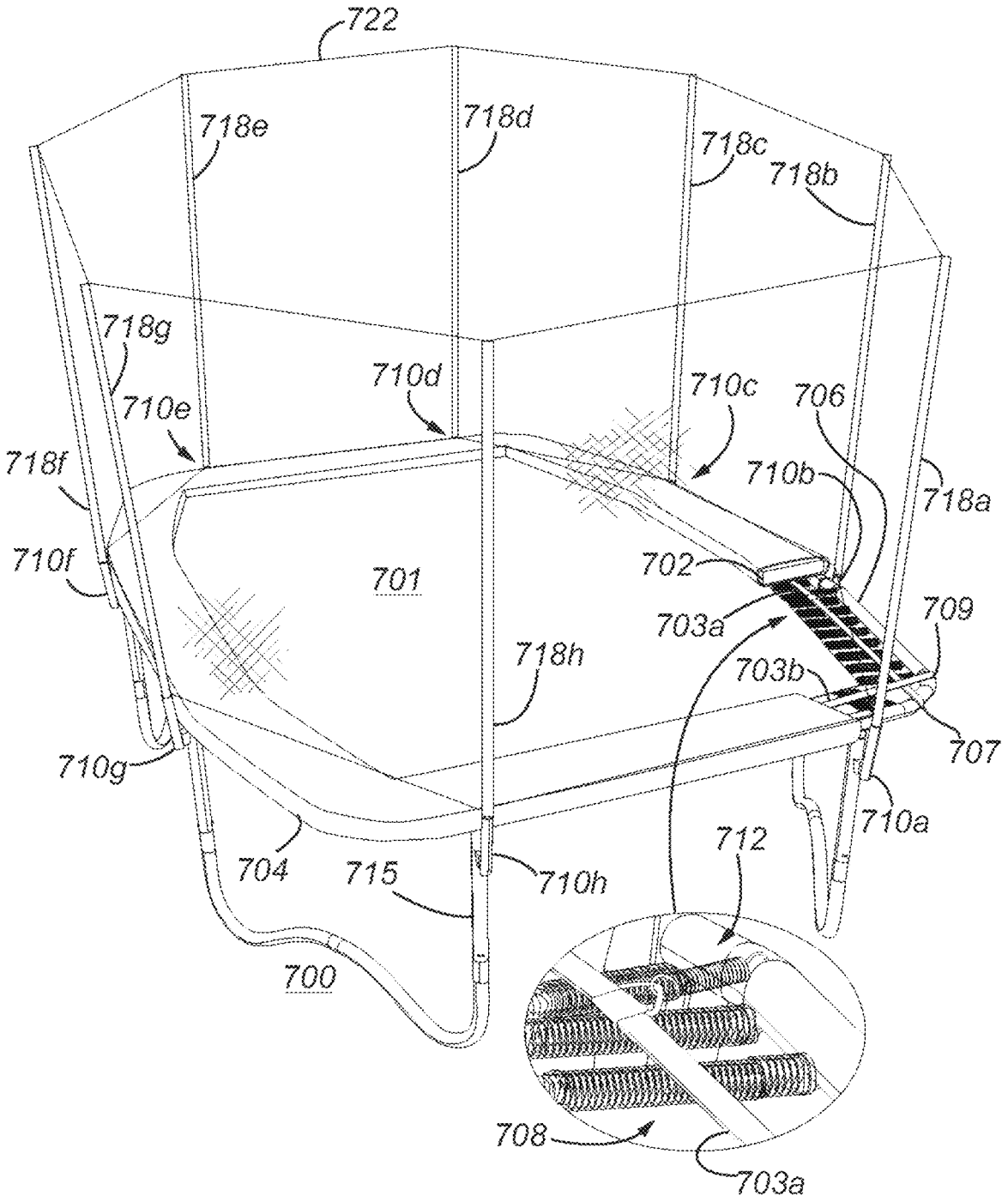
FIG. 7 illustrates a perspective view of a trampoline 700 having tensioning straps 703*a*-703*d* and tensioning straps 704*a*-704*d* that provide a stiffer frame 706 for the trampoline 700, according to an embodiment of the invention.

FIG. 7 illustrates a perspective view of a trampoline 700 having tensioning straps 703*a*-703*d* that provide a stiffer frame 706 for the trampoline 700, according to an embodiment of the invention. Each strap 703*a*-703*d* is fastened at opposite ends of the frame 706. In other words, the tensioning strap 703*a* is fastened at point 707 and the tensioning strap 703*b* is fastened at 709. Likewise, the tensioning straps 703*a*-703*d* are respectfully fastened at similar points around the frame 706, according to an embodiment of the invention. Note: only portions of straps 703*a*, 703*b* are shown in FIG. 7. However, the straps not shown are intended to be positioned in a manner consistent with the positioning of the straps shown in FIGS. 1-6, according to an embodiment of the invention.

The tensioning straps 703*a*, 703*b* attached to the points 707, 709 under tension. The tension may be applied in a number of ways, as discussed with respect to FIGS. 1-6.

The tensioning straps 703*a*, 703*b* may also be attached to a side of the frame 706 by sideways straps, such as the sideways strap 712 that holds the tensioning strap 703*a* under tension to the frame 706, according to an embodiment of the invention.

The combination of the tension provided at points like point 707 for the strap 703*a* and point 709 for the strap 703*b* and additionally by the sideways strap 712 for the strap 703*a* may provide a significant tension increase in comparison to a frame 706 having no such tensioning mechanism. The additional tension provided by the strap 703*a*, connected under tension at point 707 and at another point not shown in FIG. 7 (but paired with another point like the points 107*a*, 109*a* in FIG. 1) and under further tension by the sideways strap 712 may increase the tension in the frame 706 from 300 N to 800 N, according to an embodiment of the invention. The range of increased tension depends on a variety of factors, including the cost of components, thus even lower levels of tension may be applied in some embodiments, such as 250 N.

The trampoline 700 includes a mat 701 held to the frame 706 by a plurality of resilient members 708, e.g., helical springs. Each resilient member attaches to a respective D-ring that itself attaches to the frame 706. The tension between the mat 701 and the resilient members 708 creates a suspension system for the trampoline 700. The resilient members 708 comprise a suspension system between the mat 701 and the frame 706 for the trampoline 700. Trampoline users jump or bounce on the mat 701 in a vertical direction and possibly also move in a horizontal direction perpendicular to the first direction.

As previously discussed, the flexible mat 701 is retained in tension by a plurality of resilient members 708 (e.g., a coiled spring), according to an embodiment of the invention. The resilient members 708 are attached at or adjacent to an edge of the flexible mat 701 by attachments that include D-shaped or triangle-shaped rings. The attachment permits the at least one resilient member 708 to connect to the flexible mat 701. As shown in FIG. 7, the resilient members 708 attach on a lower side of the frame 706.

The fabric of the flexible mat 701 that users jump or bounce on is often not elastic itself, instead the resilient members 708 (e.g., helical springs) provide the elasticity which creates the potential energy. The thickness of the flexible mat 701 is typically in the range of 0.2 mm to 1 mm. However, the flexible mat 701 is usually reinforced at its edge, resulting in a higher thickness at the edge of the flexible mat 701.

The trampoline 700 comprises the flexible mat 701 and an edge pad 703. The flexible mat 701 is encompassed by the frame 706. The frame 706 comprises legs 715, such that the trampoline 700 stands on the ground via the legs 715. The edge pad 703 covers the resilient members 708 (e.g., a coiled spring) and the frame 706. FIG. 7 shows the resilient member 708 in a cutaway of the edge pad 704 that has also been shown in an exploded view. The resilient members 708 surround the flexible mat 701 and attach to the frame 706. The edge pad 704 would normally provide a complete covering without the cutaway portion shown in FIG. 7. In the illustrated embodiment, the flexible mat 701 and the surrounding frame 706 are shown as essentially rectangular (e.g., stadium shaped), but they may also be e.g. oval, circular, or square.

The trampoline 700 includes a safety net 722 attached to a number of safety poles 718*a*-718*h*. The safety net 722 attaches to the outside edge of the edge pad 704, according to an embodiment of the invention. The safety net 722 and safety poles 718*a*-718*h* may be configured in a manner such as disclosed in the applicants' PCT/EP2017/057961 and/or as disclosed in applicants' pending EP18154158.2 application. Both applications are incorporated herein by reference.

The safety net 722 prevents a user from falling off the flexible mat 701 and hitting the ground. The safety net 722 may be retained by a safety net retainer, e.g. a number of support poles 718*a*-718*h* extending upwardly from the frame 706 for carrying the safety net 722 surrounding the flexible mat 701, according to an embodiment of the invention.

Embodiments of the invention may comprise a kit that is provided to the user in the form of a series of parts, such as a flexible mat, an edge pad, a frame (possibly in a number of pieces), a plurality of resilient members, and a safety layer. Instructions for assembling a trampoline comprising these parts can be provided to the user.

The trampolines described herein, such as but not limited to the trampoline 700 shown in FIG. 7 are amenable to assembly, particularly assembly outside of the factory where they were made such as by a user or a delivery person. The assembly can typically be accomplished by hand or with a minimum number of tools, according to an embodiment of the invention. The legs (e.g., the legs 715 shown in FIG. 7) are typically attached to the frame (e.g., the frame 706. The resilient members (e.g., the resilient members 708) may be next attached to the fame, e.g., the frame 706. The tensioning straps 703*a*-703*b* may next be applied. The edge pad, e.g., the edge pad 704 may be next placed on top of the frame 706 and the resilient members, and attached to the tensioning members. The safety poles 718*a*-718*h* may be next attached to the frame 706, and the safety net 722 may be next attached. In some embodiments, the safety net 722 may need to be attached or placed between the flexible mat 701 and the resilient members 708 prior to the connection of the flexible mat 701 and the resilient members 708, according to an embodiment of the invention.

Further modifications of the invention within the scope of the appended claims are feasible. As such, the present invention should not be considered as limited by the embodiments and figures described herein. Rather, the full scope of the invention should be determined by the appended claims, with reference to the description and drawings.

Various embodiments of the invention have been described in detail with reference to the accompanying drawings. References made to particular examples and implementations are for illustrative purposes, and are not intended to limit the scope of the invention or the claims.

It should be apparent to those skilled in the art that many more modifications of the trampoline besides those already described are possible without departing from the inventive concepts herein. The inventive subject matter, therefore, is not to be restricted except by the scope of the appended claims. Moreover, in interpreting both the specification and the claims, all terms should be interpreted in the broadest possible manner consistent with the context.

Headings and sub-headings provided herein have been provided as an assistance to the reader and are not meant to limit the scope of the invention disclosed herein. Headings and sub-headings are not intended to be the sole or exclusive location for the discussion of a particular topic.

While specific embodiments of the invention have been illustrated and described, it will be clear that the invention is not limited to these embodiments only. Embodiments of the invention discussed herein may have generally implied the use of materials from certain named equipment manufacturers; however, the invention may be adapted for use with equipment from other sources and manufacturers. Equipment used in conjunction with the invention may be configured to operate according to conventional methods and protocols and/or may be configured to operate according to specialized protocols. Numerous modifications, changes, variations, substitutions and equivalents will be apparent to those skilled in the art without departing from the spirit and scope of the invention as described in the claims. In general, in the following claims, the terms used should not be construed to limit the invention to the specific embodiments disclosed in the specification, but should be construed to include all systems and methods that operate under the claims set forth hereinbelow. Thus, it is intended that the invention covers the modifications and variations of this invention provided they come within the scope of the appended claims and their equivalents.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

We claim:

1. A trampoline, comprising:

a frame having a circumference, the circumference having a plurality of sequentially arranged tension strap connection points;

a flexible mat inside the circumference;

a plurality of resilient members attached to the frame and to the flexible mat, wherein the resilient members receive kinetic energy from a user jumping on the flexible mat, causing the user to be raised above a surface of the flexible mat; and a plurality of first tensioning straps, each strap of the plurality of first tensioning straps attached under tension to the frame, a first end of each first tensioning strap of the plurality of first tensioning straps attached at a tension strap connection point of the plurality of sequentially arranged tension strap connection points and a second end of each first tensioning strap of the plurality of first tensioning straps attached under tension to a next sequential tension strap connection point of the plurality of sequentially arranged tensioning straps, each first tensioning strap disposed with an orientation comprising one of parallel or tangent to an edge of the flexible mat, the plurality of first tensioning straps stiffening the frame when the user jumps on the flexible mat.

2. The trampoline of claim 1 wherein each strap of the plurality of first tensioning straps provides the frame with at least an additional 250 N of tension.

3. The trampoline of claim 1, wherein the frame has a substantially rectangular circumference having four corners, wherein the plurality of sequentially arranged tension strap connection points comprises four tension strap connection points, the four tension strap connection points proximally located at each of the four corners of the frame, wherein the plurality of first tensioning straps comprises four tensioning straps, wherein a first end of a first tensioning strap of the four tensioning straps is attached to a first tension strap connection point of the four tension strap connection points and a second end of the first tensioning strap of the four tensioning straps is attached to a second tension strap connection point of the four tension strap connection points, wherein a first end of a second tensioning strap of the four tensioning straps is attached to the second tension strap connection point of the four tension strap connection points and a second end of the second tensioning strap of the four tensioning straps is attached to a third tension strap connection point of the four tension strap connection points, wherein a first end of a third tensioning strap of the four tensioning straps is attached to the third tension strap connection point of the four tension strap connection points and a second end of the third tensioning strap of the four tensioning straps is attached to a fourth tension strap connection point of the four tension strap connection points, wherein a first end of a fourth tensioning strap of the four tensioning straps is attached to the fourth tension strap connection point of the four tension strap connection points and a second end of the fourth tensioning strap of the four tensioning straps is attached to the first tension strap connection point of the four tension strap connection points, and wherein each tensioning strap of the four tensioning straps is parallel to a respective edge of the flexible mat.

4. The trampoline of claim 1, further comprising:

an edge pad resting on an upper surface of the frame and extending to the flexible mat, covering the plurality of resilient members, wherein the edge pad includes a material to absorb shock from the user falling on the edge pad.

5. The trampoline of claim 4, further comprising:

a plurality of sideways straps that attach to the edge pad and to the frame, wherein the plurality of sideways straps return the edge pad to a resting position after the user has displaced the edge pad while jumping.

6. The trampoline of claim 5 wherein each sideways strap of the plurality of sideways straps comprises:

a hook attached to the frame; and a first flexible material portion attached to the hook and to the edge pad.

7. The trampoline of claim 6 wherein the first flexible material portion comprises a rubber band.

8. The trampoline of claim 5 wherein the plurality of first tensioning straps are attached to the frame by the plurality of sideways straps wherein each sideways strap of the plurality of sideways straps imparts further stiffening to the frame when the user jumps on the flexible mat.

9. The trampoline of claim 8 wherein each sideways strap of the plurality of sideways straps comprises:

a hook attached to the frame; and a second flexible material portion attached to the hook and a tensioning strap of the plurality of tensioning straps.

10. The trampoline of claim 9 wherein the second flexible material portion comprises a rubber band.

11. The trampoline of claim 4 wherein the edge pad further comprises a plurality of receptacles for holding the plurality of the first tensioning straps.

12. The trampoline of claim 11 wherein the plurality of receptacles comprise one of a plurality of loops on the edge pad and a plurality of pockets on the edge pad.

13. The trampoline of claim 1, further comprising:

a plurality of sideways straps, each sideways strap attached to the frame and to a tensioning strap of the plurality of tensioning straps, wherein each sideways strap of the plurality of sideways straps imparts further stiffening to the frame when the user jumps on the flexible mat.

14. The trampoline of claim 13 wherein each sideways strap of the plurality of sideways straps comprises a spring.

15. The trampoline of claim 1, further comprising:

a plurality of second tensioning straps each strap of the plurality of second tensioning straps attached under tension to the frame, wherein each strap of the plurality of the second tensioning straps attached under tension to the frame further stiffens the frame when the user jumps on the flexible mat.

16. The trampoline of claim 15, further comprising:

a plurality of ratchets such that each tensioning strap of the plurality of second tensioning straps receives increased tension from at least one ratchet of the plurality of ratchets.

17. The trampoline of claim 16 wherein each tensioning strap of the plurality of second tensioning straps increases tension to the frame by at least 2500 N.

18. The trampoline of claim 17 wherein the plurality of first tensioning straps and the plurality of second tensioning straps render the trampoline substantially silent when the user jumps on the mat.

19. The trampoline of claim 1, further comprising:

a safety net surrounding an upper surface of the frame.

20. The trampoline of claim 1 wherein the frame has one of a substantially rectangular shape, a substantially square shape, a stadium shape, and a circular shape.

* * * * *